US007392915B2

(12) United States Patent
Sorsa

(10) Patent No.: US 7,392,915 B2
(45) Date of Patent: Jul. 1, 2008

(54) METHOD FOR CONTROLLING SPREADER IN CRANE

(75) Inventor: Timo Sorsa, Jokela (FI)

(73) Assignee: KCI Konecranes PLC, Hyvinkää (FI)

( * ) Notice: Subject to any disclaimer, the term of this patent is extended or adjusted under 35 U.S.C. 154(b) by 42 days.

(21) Appl. No.: 10/515,252

(22) PCT Filed: Mar. 30, 2004

(86) PCT No.: PCT/FI2004/000188

§ 371 (c)(1),
(2), (4) Date: May 19, 2005

(87) PCT Pub. No.: WO2004/087555

PCT Pub. Date: Oct. 14, 2004

(65) Prior Publication Data

US 2005/0218099 A1 Oct. 6, 2005

(30) Foreign Application Priority Data

Apr. 1, 2003 (FI) ..... 20030485

(51) Int. Cl.
*B66C 13/06* (2006.01)

(52) U.S. Cl. ..... 212/270; 212/274

(58) Field of Classification Search ..... 212/274, 212/270

See application file for complete search history.

(56) References Cited

U.S. PATENT DOCUMENTS 5,769,250 A 6/1998 Jussila et al.

FOREIGN PATENT DOCUMENTS

| | | | |
|---|---|---|---|
| JP | 4-303390 | A | 10/1992 |
| JP | 9-158254 | A | 6/1997 |
| WO | WO-97/08094 | A1 | 3/1997 |
| WO | WO-02/22488 | A1 | 3/2002 |
| WO | WO-02/076873 | A1 | 10/2002 |

*Primary Examiner*—Thomas J. Brahan
(74) *Attorney, Agent, or Firm*—Muncy, Geissler, Olds & Lowe, PLLC

(57) ABSTRACT

The invention relates to a method for controlling swaying and swinging of a spreader in a crane and the load attached thereto, the crane comprising: a trolley, hoist gears, hoisting ropes, on which the spreader is suspended from the trolley, auxiliary gears provided with motors and motor control equipment and auxiliary ropes, and in which method the forces of the auxiliary ropes exerted on the spreader are controlled by moving the auxiliary ropes using the auxiliary gears by means of torque instructions ($T_{control}$) obtained on the basis of the rope forces ($F_{rope}$) of the auxiliary ropes and the rotating speed data (n) of the auxiliary gears, and whereby the torque instruction of the motor control equipment in each auxiliary gear is formed gear-specifically as a sum of a static ($T_{stat}$) and a dynamic ($T_{dyn,\ calc}$) term.

4 Claims, 3 Drawing Sheets

METHOD FOR CONTROLLING SPREADER IN CRANE

BACKGROUND OF THE INVENTION

The invention relates to a method for controlling swaying and swinging of a spreader in a crane and the load attached thereto, the crane comprising: a trolley, hoist gears provided with hoist drums placed in the trolley, hoisting ropes arranged on the hoist drums, on which the spreader is suspended from the trolley and which are directed back to the trolley through sheaves arranged on the spreader, whereby the swaying and swinging is controlled by control equipment comprising: four auxiliary gears provided with rope drums including motors and motor control equipment placed in the trolley, auxiliary ropes arranged on the rope drums of the auxiliary gears, sheaves for the auxiliary ropes placed in the spreader, through which sheaves the auxiliary ropes passing obliquely from the rope drums of the auxiliary gears are directed to spaces arranged in the hoist drums for the auxiliary ropes, and in which method the forces of the auxiliary ropes exerted on the spreader are controlled by moving the auxiliary ropes using the auxiliary gears by means of torque instructions obtained on the basis of the rope forces of the auxiliary ropes and the rotating speed data of the auxiliary gears using control logic that allows providing and maintaining the desired rope forces, controls the rotation and the resistance of the swinging of the motors in the auxiliary gears.

The method of the invention is known from Fl patent 101466, in which the method is presented in connection with a crane moving by means of rubber tyres and whose hoisting heights and hoisting speeds are moderate.

The method according to Fl patent 101466 adequately reduces the undesired movements of the load in the original applications thereof. Then again, in for instance the quay cranes moving on rails presented in Fl patent 108788, whose hoisting heights and moving speeds are significantly higher, the diagonal geometry of the auxiliary ropes and especially situations, in which the auxiliary ropes wound specifically on hoist drums move from one layer to another, require very rapid speed changes in the auxiliary gears. The control logic circuit presented in Fl patent 101466 is not fast enough for such a purpose.

BRIEF DESCRIPTION OF THE INVENTION

It is an object of the present invention to solve the problem presented above. This object is achieved with the method according to the invention, which is mainly characterized in that the torque instruction of the motor control equipment in each auxiliary gear is formed gear-specifically as a sum of a static and a dynamic term.

Preferably this is carried out so that the static torque instruction is calculated on the basis of the reference value of the rope force in the auxiliary gear, the measuring data of the rope force and the rotating speed of the auxiliary gear, and the dynamic torque instruction, i.e. the dynamic feed-forward term, is calculated from the change occurring in the calculated rotating speed of the auxiliary gear.

The method according to the invention allows removing the rough and jerky correcting movements of the spreader and the load from the cranes built for high speeds and hoisting heights, which have made the use of the method known from Fl patent 101466 impossible as such.

The details of the invention and the advantages thereof will be described in the following detailed description of the invention.

BRIEF DESCRIPTION OF THE DRAWINGS

In the following, the method according to the invention will be explained in greater detail by means of a crane arrangement, in which the method can be successfully applied with reference to the accompanying drawings, in which.

DETAILED DESCRIPTION OF THE INVENTION

Figure 1:
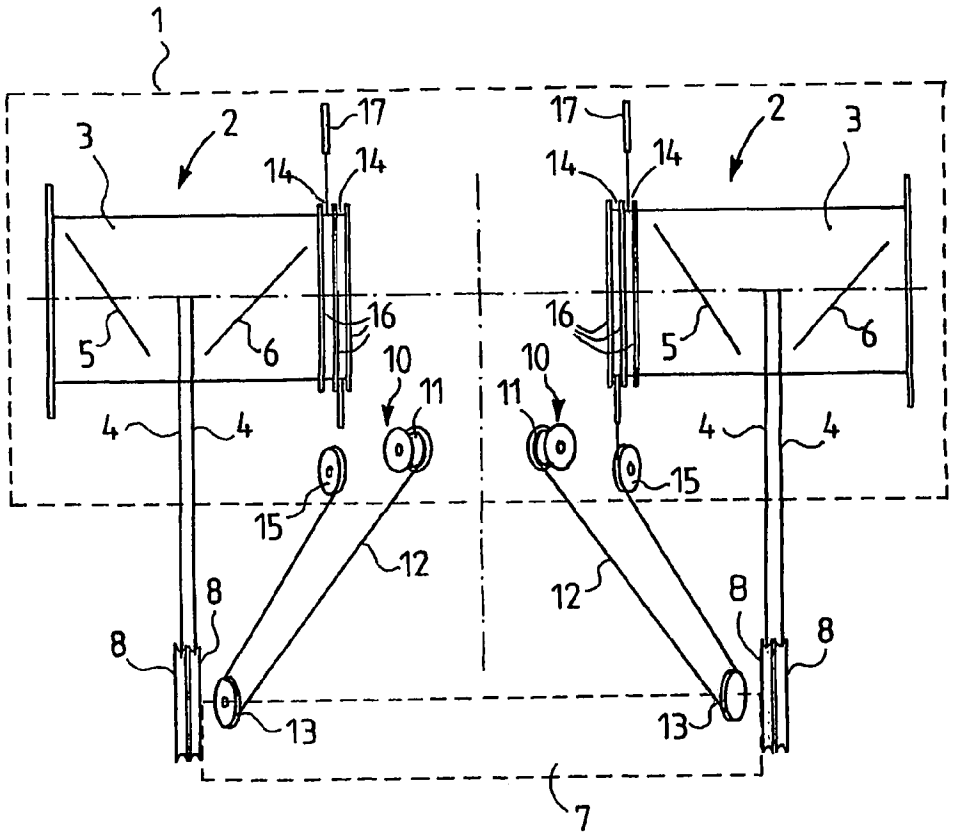
FIG. 1 shows a simplified schematic view of a crane arrangement seen from the travel direction of a trolley.
Figure 2:
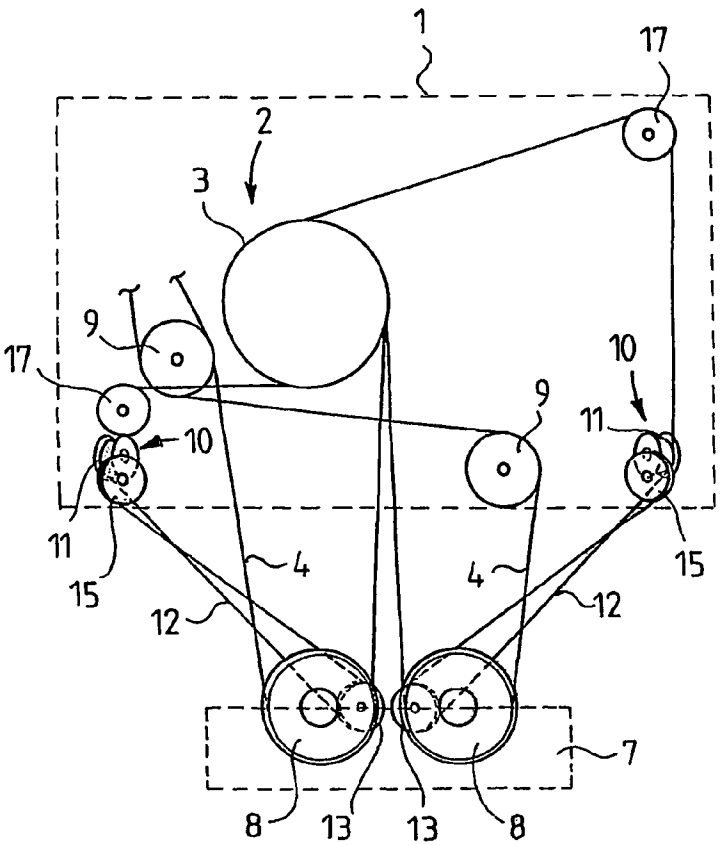
FIG. 2 is a side view of the arrangement shown in FIG. 1.
Figure 4:
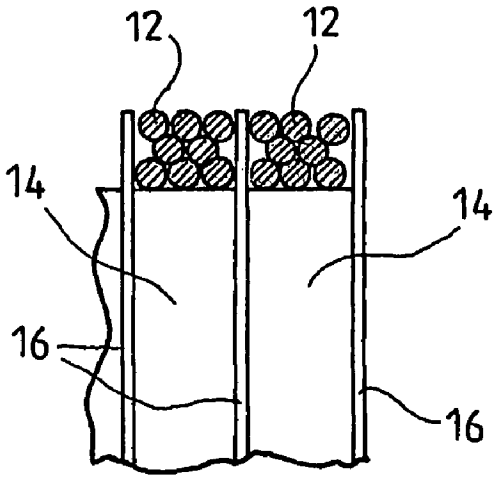
FIG. 4 shows enlarged auxiliary rope spaces.
Figure 3:
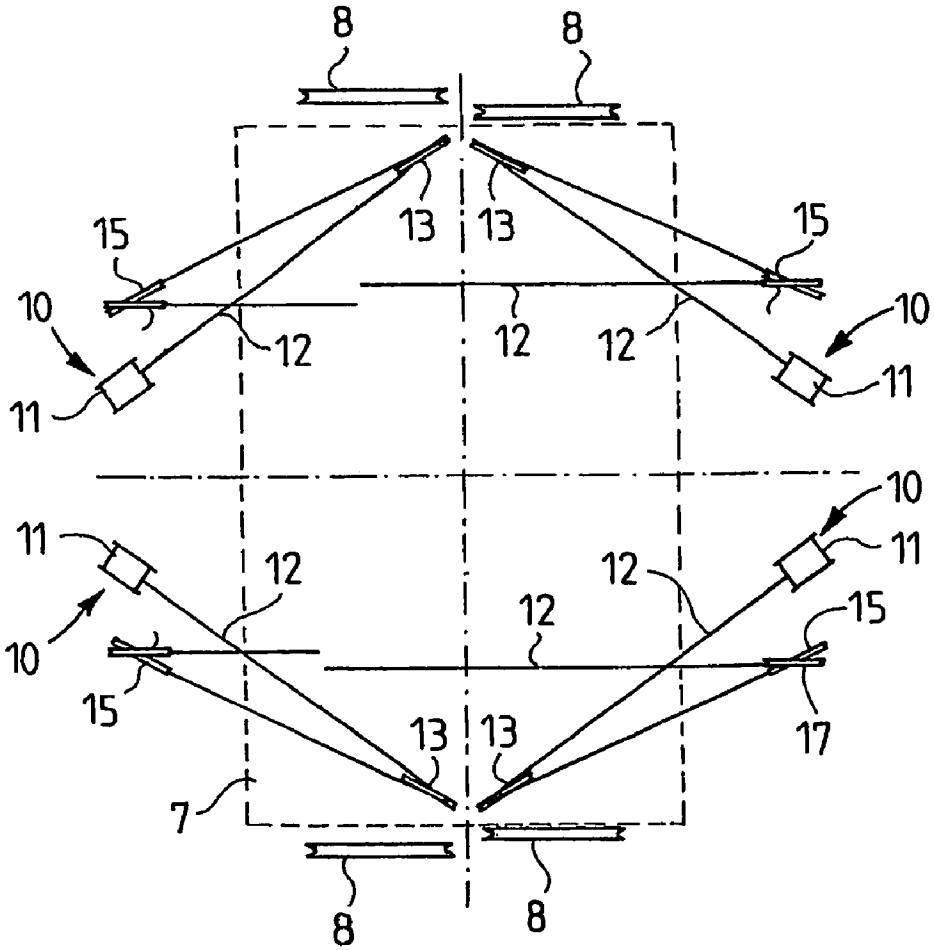
FIG. 3 is a top view of the arrangement shown in FIG. 1.

The crane arrangement shown in the drawings, known for instance from Fl patent 108788, comprises two hoist gears 2 with hoist drums 3 placed in a crane trolley 1. These elements are arranged in the trolley 1 such that the longitudinal axes thereof are in the same line A. Two hoisting ropes 4 are arranged in parallel on the hoist drum 3 of both hoist gears 2 so that grooves 5 and 6 reserved for the ropes on the surface of the hoist drum 3 are opposite in direction. A spreader 7 for fastening a load to be hoisted (not shown) is suspended on the hoisting ropes 4. The spreader is provided with sheaves 8 for the hoisting ropes 4, through which the hoisting ropes 4 are directed back to the trolley 1. The sheaves 8 are placed in the spreader 7 substantially directly below the longitudinal middle points of the hoist drums 3, whereby the position of the hoisting ropes remains substantially symmetrical in the vertical direction despite the different hoisting heights. The hoisting ropes 4 are directed to the trolley 1 through additional sheaves 9 and secured to the crane through possible overload protections (not shown).

The arrangement also comprises four auxiliary gears 10 placed in the trolley 1 for controlling swaying and swinging of the spreader 7 and the load attached thereto. Preferably, the auxiliary gears 10 are arranged in a rectangle (although an asymmetrical arrangement is also possible) so that one auxiliary gear 10 is located in each corner of the rectangle. A rope drum 11 of each auxiliary gear 10 is provided with an auxiliary rope 12 that passes obliquely into sheaves 13 located in the spreader 7 and through them back towards the hoist drums 3 and into spaces 14, which are preferably designed and reserved for them in the hoist drums 3. The sheaves 13 are also preferably arranged in a rectangle so that one sheave 13 is located in each corner of the rectangle. It is necessary to arrange the auxiliary ropes 12 obliquely in order that the vertical forces required to prevent or reduce swaying or swinging could be exerted on the spreader 7 and the load by means of the auxiliary gears 12 and the auxiliary ropes. Consequently, the hoisting ropes 4 can also be positioned completely vertically. The control of such swaying and swinging will be described below.

The auxiliary ropes 12 are preferably provided with at least one set of additional sheaves 15 arranged in the trolley 1, through which sheaves the auxiliary ropes 12 arriving from the spreader 7 and the first set of sheaves 13 therein are directed to auxiliary rope spaces 14 of the hoist drums 3. Thus, each auxiliary rope 12 is provided with a stationary point in the trolley 1 relative thereto and independent of the hoisting height, whereby the movement of the auxiliary ropes 12 in relation to the drum on the side of the trolley 1 is avoided. In addition, the spaces 14 for the auxiliary ropes are formed at the ends of the hoist drums 3 within a considerably narrow area, for instance by means of flanges 16, so that the auxiliary ropes 12 can be wound onto a plurality of layers, in which case the angle of the auxiliary ropes 12 in relation to the hoist drum 3 remains almost constant at any hoisting height, and the hoist drum 3 is made considerably shorter than previously.

What is further arranged between the additional sheaves 15 and the hoist drums 3 are sheaves 17, through which the auxiliary ropes 12 pass, but these are mainly arranged to ensure an unobstructed passage for the auxiliary ropes 12.

In accordance with Fl patent 101466, the auxiliary gears 10 can be, for instance, identical, mechanically independent systems, the control of which is implemented totally electrically and determined on the basis of the weighting data of the auxiliary rope 12, the rotating speed of the rope drum 11 i.e. the auxiliary gear 10, and similar variables. A sufficient amount of auxiliary rope 12 is always stored on the rope drum 11, and thereby the compensation created by different geometries of the auxiliary ropes 12 and the hoist ropes 4 will be automatically solved. By means of a specific control logic controlling each auxiliary gear 10, the forces exerted on each auxiliary rope 12 are controlled on the basis of the above-mentioned variables in such a manner that the spreader 7 and the load suspended thereto are not allowed to sway or swing. It is not necessary to place the auxiliary gears 10 totally symmetrically, since the above-mentioned control logic is able to take into account the asymmetry, if it is known in advance.

Figure 5:
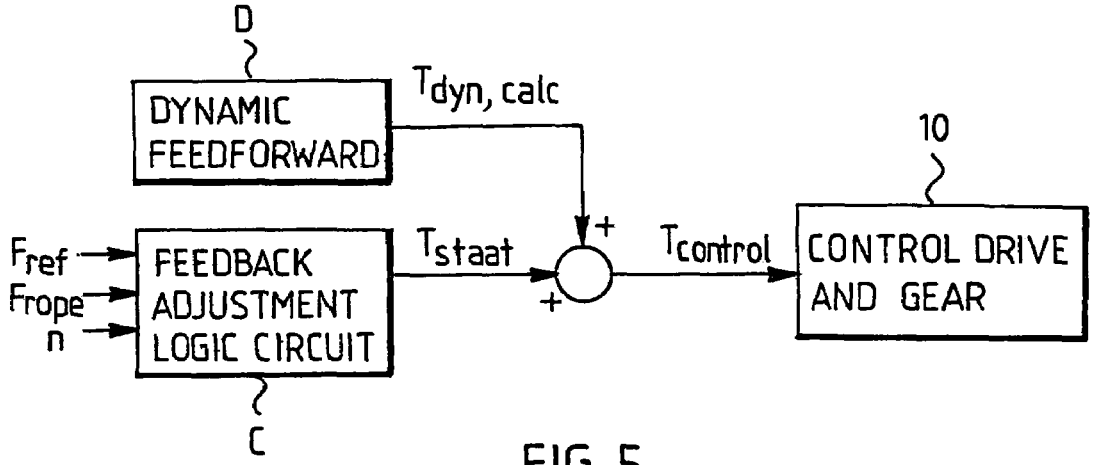
FIG. 5 shows a diagram for providing the previously known control logic circuit with a feedforward according to the invention.

Referring now to FIG. 5, the movements of the spreader 7 and the load attached thereto are controlled in accordance with the invention as follows.

A static torque instruction $T_{stat}$ is gear-specifically calculated for each auxiliary gear 10 by means of a separately arranged feedback control logic circuit C, which may, for instance, refer to a circuit known from Fl patent 101466 comprising a force controller and a speed controller, in which the static torque instruction $T_{stat}$ is calculated on the basis of the reference value $F_{ref}$ of the rope force in each auxiliary gear 10, the measuring data of the rope force $F_{rope}$ and the rotating speed n of the auxiliary gear 10. The rope force $F_{rope}$ may represent a piece of information measured by means of an appropriate weighing sensor or the rope force can be calculated from the actual value of the torque determined by the motor control equipment (for example a frequency converter) in the auxiliary gear 10 as will be shown below. The rotating speed n shows, in turn, how the load sways from the position of equilibrium thereof. Setting the reference value $F_{ref}$ of the rope force is described in detail in the above-mentioned patent and will therefore not be described in more detail in this context.

Let us add into this static torque instruction $T_{stat}$ obtained in a previously known manner the gear-specific dynamic torque instruction $T_{dyn,\ calc}$ according to the invention, i.e. a dynamic feedforward term, which is calculated using a dynamic feedforward circuit D from the change in the calculated rotating speed $n_{calc}$ of each auxiliary gear 10. The gear-specific torque instruction $T_{control}$, by which the control of the spreader 7 and the load attached thereto can be implemented, provided for the motor control equipment in each auxiliary gear 10 is the sum of the static torque instruction $T_{stat}$ and the dynamic torque instruction $T_{dyn,\ calc}$.

The dynamic feedforward term $T_{dyn,\ calc}$ is preferably calculated in accordance with the following formula:

$$T_{dyn,\ calc}=b\times J\times d/dt(n_{calc}),\text{ where}$$

b=a scale factor of units

J=an inertia mass parameter of the auxiliary gear 10, and $d/dt(n_{calc})$=the change in the calculated speed of the auxiliary gear 10 (at the same time the desired speed change, particularly when a layer is changed).

The positive effect of feedforward for controlling the spreader 7 and the load is in addition to changing the layers of the auxiliary ropes 12 also shown when the hoisting movement is accelerated or decelerated and when the spreader 7 and the load are at a high position (all ropes being short), whereby the auxiliary gears 10 must rapidly also change the speed thereof.

The force lifting the load of each auxiliary rope 10 is required for weighing the load. Since the dynamic additional torque $T_{dyn,\ calc}$ provided by the dynamic feedforward is at times high in order to accelerate the inertia masses of the auxiliary gear 10, the static conversion from the torque data $T_{act}$ provided by the motor control equipment to rope force $F_{rope}$ provides incorrect information about the rope force.

Figure 6:
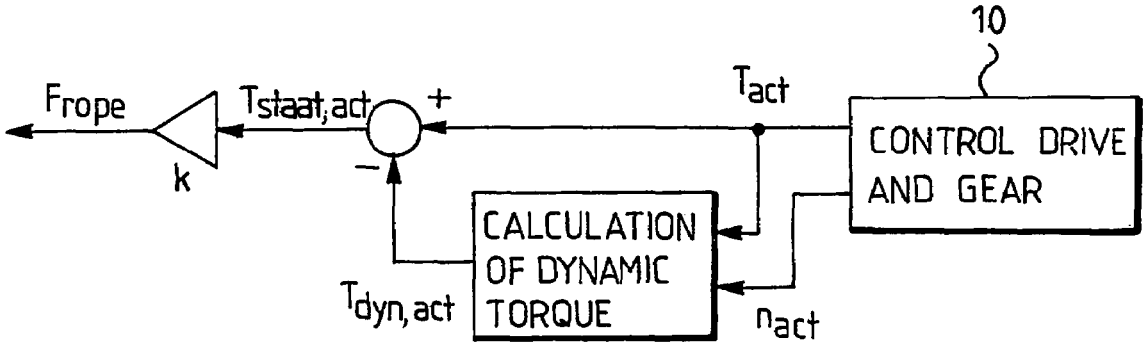
FIG. 6 is a diagram showing how to calculate the rope force based on the torque implemented in the auxiliary gear.

This problem can be solved in accordance with the formula shown in FIG. 6 in such a manner that when the rope force $F_{rope}$ of the auxiliary rope 10 is calculated, the implemented dynamic torque $T_{dyn,\ act}$ required for accelerating the flywheels is reduced from the motor torque $T_{act}$ calculated by the motor control equipment, whereby the implemented static torque $T_{stat,\ act}$ representing the rope force $F_{rope}$ remains.

The rope force $F_{rope}$ can thus be calculated according to the following formula:

$$F_{rope}=k\times(T_{act}-b\times J\times d/dt(n_{act})),\text{ where}$$

b=a scale factor of units $n_{act}$=the measured rotating speed of the auxiliary gear 10 (or $d/dt\ (n_{act})$=the measured acceleration of the auxiliary gear).

J=an inertia mass parameter of the auxiliary gear 10

K a constant conversion factor $T_{act}$=the implemented torque data of the auxiliary gear 10.

The rope force $F_{rope}$ obtained must also be divided into a vertical and horizontal force component, so as to take the vertical component affecting the determination of the load into account.

The specification of the above invention is merely intended to illustrate the method according to the invention by means of one preferable embodiment. However, a person skilled in the art is able to apply the method in a broader sense within the scope of the appended claims. Therefore, the same method can be used with the crane shown in Fl patent 101466, even though the load thereof is adequately controlled by means of the previously known method. Numerous practical alternatives exist for implementing the details of the method that are incorporated within the scope of the invention defined in the claims.

The invention claimed is:

1. A method for controlling swaying and swinging of a spreader in a crane and the load attached thereto, the crane comprising:

a trolley, hoist gears provided with hoist drums placed in the trolley, hoisting ropes arranged on the hoist drums, on which the spreader is suspended from the trolley and which are directed back to the trolley through sheaves arranged on the spreader, the swaying and swinging being controlled by control equipment comprising:

four auxiliary gears provided with rope drums and including motors and motor control equipment placed in the trolley, auxiliary ropes arranged on the rope drums of the auxiliary gears, sheaves for the auxiliary ropes placed in the spreader, through which sheaves the auxiliary ropes passing obliquely from the rope drums of the auxiliary gears are directed to spaces arranged in the hoist drums for the auxiliary ropes, said method comprising;

controlling forces exerted on the spreader by each auxiliary rope driven by a corresponding auxiliary gear based on torque instructions;

determining said torque instructions by means of control logic which receives force data of the corresponding auxiliary rope and rotating speed data of the corresponding auxiliary gear, said control logic providing and maintaining the desired rope forces, controlling the rotation and the resistance of the swinging of the spreader using said motor in the corresponding auxiliary gear;

forming said torque instruction in each corresponding auxiliary gear as sum of a static and a dynamic term;

calculating the static torque instruction based on a reference value of the rope force in the auxiliary gear, a measuring data of the rope force and the rotating speed of the auxiliary gear; and a dynamic feed forward torque instruction $T_{dyn,\ calc}$, based on a change occurring in the calculated rotating speed of each auxiliary gear.

2. A method as claimed in claim 1, further comprising calculating the dynamic feedforward term $T_{dyn,\ calc}$ based on the following formula:

$$T_{dyn,\ calc}=b\times J\times d/dt(n_{calc}),\ \text{where}$$

b=a scale factor of units

J=an inertia mass parameter of the auxiliary gear, and $d/dt(n_{calc})$=the change in the calculated speed of the auxiliary gear (the desired speed change).

3. A method as claimed in claim 1 calculating the rope force of each auxiliary rope by subtracting the dynamic torque required for accelerating the flywheel mass from the motor torque calculated by the motor control equipment, leaving the static torque representing the rope force.

4. A method as claimed in claim 3, further comprising calculating the rope force, $F_{rope}$, in accordance with the following formula:

$$F_{rope}=k\times(T_{act}-b\times J\times d/dt(n_{act})),\ \text{where}$$

b=a scale factor of units $n_{act}$=the measured rotating speed of the auxiliary gear, or $d/dt\ (n_{act})$=the measured acceleration of the auxiliary gear, J=an inertia mass parameter of the auxiliary gear K=a constant conversion factor $T_{act}$=the implemented torque data of the auxiliary gear.

* * * * *